US008632156B2

(12) United States Patent
Korogi et al.

(10) Patent No.: US 8,632,156 B2
(45) Date of Patent: Jan. 21, 2014

(54) PAPER FLOATING DETECTION APPARATUS, PAPER CONVEYANCE APPARATUS AND IMAGE RECORDING APPARATUS

(75) Inventors: Yutaka Korogi, Kanagawa-ken (JP); Tatsuya Nitta, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 246 days.

(21) Appl. No.: 13/073,656

(22) Filed: Mar. 28, 2011

(65) Prior Publication Data

US 2011/0234675 A1 Sep. 29, 2011

(30) Foreign Application Priority Data

Mar. 29, 2010 (JP) ..... 2010-075488

(51) Int. Cl.

| | |
|---|---|
| ***B41J 29/38*** | (2006.01) |
| *B41J 2/01* | (2006.01) |
| *B65H 7/02* | (2006.01) |
| *B65H 5/02* | (2006.01) |
| *B65H 5/04* | (2006.01) |

(52) U.S. Cl.
USPC ..... 347/16; 347/101; 347/104; 347/105; 271/258.01; 271/265.01; 271/275; 271/276

(58) Field of Classification Search
USPC ..... 347/16, 101, 104, 105; 271/258.01, 271/265.01, 275, 276
See application file for complete search history.

(56) References Cited

U.S. PATENT DOCUMENTS

| | | | | |
|---|---|---|---|---|
| 6,827,414 | B2 * | 12/2004 | Iwatsuki et al. | 347/14 |
| 7,387,683 | B2 * | 6/2008 | Kim et al. | 118/670 |
| 7,880,873 | B2 * | 2/2011 | Nakamura et al. | 356/237.1 |
| 8,162,427 | B2 * | 4/2012 | Fukui | 347/16 |
| 2002/0190191 | A1 * | 12/2002 | Maurin et al. | 250/208.4 |
| 2003/0007026 | A1 | 1/2003 | Matsumoto et al. | |
| 2005/0231578 | A1 * | 10/2005 | Tajima | 347/104 |
| 2011/0234730 | A1 * | 9/2011 | Fukui et al. | 347/104 |
| 2012/0224012 | A1 * | 9/2012 | Inoue et al. | 347/104 |

FOREIGN PATENT DOCUMENTS

| | | | | |
|---|---|---|---|---|
| JP | 9-226150 | A | 9/1997 | |
| JP | 2002-172805 | A | 6/2002 | |
| JP | 2004299155 | A * | 10/2004 | B41J 2/01 |
| JP | 2005313519 | A * | 11/2005 | |
| JP | 2006102642 | A * | 4/2006 | |
| JP | 2007-76109 | A | 3/2007 | |
| JP | 2007085960 | A * | 4/2007 | |
| JP | 2008126155 | A * | 6/2008 | |
| JP | 2008142589 | A * | 6/2008 | |
| JP | 2010076872 | A * | 4/2010 | |

* cited by examiner

*Primary Examiner* — Laura Martin
*Assistant Examiner* — Jeremy Bishop
(74) *Attorney, Agent, or Firm* — Birch, Stewart, Kolasch & Birch, LLP

(57) ABSTRACT

A paper floating detection apparatus is arranged at a conveyance path of a conveyance device which holds paper on a conveyance surface and conveys the paper in a conveyance direction while causing a surface of the paper to face a droplet ejection head. The detection apparatus includes: a light emission unit and a light reception unit arranged to face each other across the conveyance path, such that an optical path of detection light emitted from the light emission unit and received by the light reception unit is substantially perpendicular to the conveyance direction, floating up of the paper from the conveyance surface being detected by detecting that the conveyed paper has shielded the detection light; and an air flow diverting guide member which is arranged in a periphery of the optical path and configured to prevent inflow of air having a temperature differential sufficient to affect the optical path.

14 Claims, 11 Drawing Sheets

PAPER FLOATING DETECTION APPARATUS, PAPER CONVEYANCE APPARATUS AND IMAGE RECORDING APPARATUS

BACKGROUND OF THE INVENTION

1. Field of the Invention

The present invention relates to a paper floating detection apparatus, a paper conveyance apparatus and an image recording apparatus, and more particularly to a paper floating detection apparatus, a paper conveyance apparatus and an image recording apparatus for detecting floating of paper in an inkjet recording unit of an inkjet recording apparatus, by means of detection light.

2. Description of the Related Art

A known image forming apparatus is an inkjet recording apparatus (inkjet printer), which has an inkjet head in which a plurality of nozzles (ink ejection ports) are arranged, and which forms an image on a recording medium by conveying the recording medium relatively with respect to the inkjet head and ejecting droplets of ink toward the recording medium from nozzles.

In the inkjet recording apparatus, when the inkjet head and the recording medium are conveyed relatively to each other, since the nozzles of the inkjet head are situated in very close proximity to the conveyed recording medium, then if the recording medium floats up from the conveyance surface while passing in the vicinity of the inkjet head, then image quality deteriorates due to change in the height at which the ink droplets are ejected, the nozzle surface may be damaged by the recording medium rubbing against the nozzle surface, or the recording medium may strike against the nozzles and cause dirt to become attached to the recording medium, and furthermore, there may be problems such as ejection failure due to paper dust blocking up the nozzles.

Therefore, various detection apparatuses have been proposed in the related art in which a light-emitting element and a light-receiving element are arranged in mutual opposition in such a manner that detection light emitted from the light-emitting element is received by the light-receiving element, and the floating of the recording medium and the ejection state of the ink droplets are determined by detecting either the recording medium or ink droplets passing through the detection light.

For example, Japanese Patent Application Publication No. 2007-076109 discloses a droplet ejection apparatus which includes a light-emitting element arranged on one side of a direction perpendicular to a direction of conveyance of a droplet ejection head, and a light-receiving sensor arranged on the other side, and a detection device which optically determines the height from a recording medium conveyance device by passing a light ray between a conveyance device which holds a recording medium and conveys the recording medium so as to face a droplet ejection head, and the droplet ejection head, the light ray being passed at a height above the conveyance device.

Moreover, for example, Japanese Patent Application Publication No. 2002-172805 discloses an inkjet recording apparatus in which an ink collection unit which collects ink droplets inside an ink droplet ejection region, a suction fan for forming an air flow toward an ink suction port connected to the ink droplet ejection region provided in the ink collection unit, and a plurality of ink shielding walls having light transmission ports for transmitting light projected from a light emission module to a light reception module are arranged in respect of an ink droplet ejection region which is interposed between a light emission module and a light reception module that determine the ejection state of ink droplets from a nozzle forming surface of an inkjet recording head; ink droplets ejected from the nozzle forming surface onto the ink droplet ejection region become an ink mist and are borne on the air current toward the ink suction port and collected by the ink collection unit, thereby preventing soiling of the light emission module and the light reception module by the ink mist and thus preventing decline in the detection accuracy of the ink ejection state.

Furthermore, for example, Japanese Patent Application Publication No. 09-226150 discloses an inkjet recording apparatus which includes an ink end detection device which records marks by ejecting ink onto a recording paper, and detects that ink has run out by detecting the presence or absence of the marks, an obstructing wall member which prevents external light from entering into the ink end detection apparatus that detects the presence or absence of marks is provided in a recording paper output tray, so as to prevent mistaken detection that ink has run out.

However, in the technology described in Japanese Patent Application Publication No. 2007-076109, the environment of the optical path between the light-emitting element and the light-receiving element is not kept uniform by covering the optical path. Moreover, in the technology described in Japanese Patent Application Publication No. 2002-172805, the whole of the optical path formed by the light emission module and the light reception module is not covered by a cover, and the described air flow is not intended to uniformize the temperature. Furthermore, the obstructing wall members described in Japanese Patent Application Publication No. 09-226150 do not prevent temperature change.

In the above-described technology in the related art, no consideration is given to change in the amount of received light due to bending of the optical path of the detection light, which is affected by changes in the air flow and temperature in the periphery of the detection light path, and hence there is a concern that erroneous detection may occur as a result of ambient changes, such as change in the air flow or temperature in the periphery of the detection light path.

Furthermore, although it might be possible to provide dividing plates inside the apparatus as a general method of controlling the temperature differential and the direction of the air flow, in a large apparatus, the dividing plates will also be large, and there is a problem in that the number of components increases in order to cover the gaps in the drive units, and therefore the apparatus becomes complex. Moreover, a method for suppressing the flow of air caused by rotation of a drum having undulations to eliminate air flow in the periphery of the optical path, and modifications for preventing temperature change, are not known in the related art.

As described above, in an inkjet recording apparatus, if the floating height of the recording medium is equal to or greater than a prescribed specific value in the recording unit, there is a risk of the recording medium rubbing against the nozzle surface of the head and causing damage to the head, and therefore it is necessary to detect the floating of the recording medium and halt the conveyance of the recording medium accordingly, before the recording medium which has floated up by a specific value or more enters into the recording unit.

In cases where a detection mechanism including a transmissive photoelectric sensor which transmits detection light in a substantially perpendicular direction to the recording medium conveyance direction is disposed in order to detect floating of a recording medium, apertures being provided respectively before the light emission surface and the light reception surface of the sensor and floating of the recording medium being detected when the light between the apertures is shielded by the recording medium, if the ambient change in the periphery of the detection light path is not taken into account as described above, then there is a problem in that the optical path bends due to temperature difference if, for example, air having a different temperature to that of the recording medium or the conveyance surface passes through the optical path of the detection light, and therefore floating of the recording medium cannot be detected at the correct height.

SUMMARY OF THE INVENTION

The present invention has been contrived in view of these circumstances, an object thereof being to provide a paper floating detection apparatus, a paper conveyance apparatus and an image recording apparatus whereby the flow of air in the periphery of the detection light path can be suppressed and the height of floating of the recording medium can be detected accurately, in an inkjet recording apparatus.

In order to attain the aforementioned object, the present invention is directed to a paper floating detection apparatus arranged at a conveyance path of a conveyance device which holds paper on a conveyance surface and conveys the paper through the conveyance path in a conveyance direction while causing a surface of the paper to face a droplet ejection head, the apparatus comprising: a light emission unit and a light reception unit which are arranged to face each other across the conveyance path, the light emission unit and the light reception unit being disposed in such a manner that an optical path of detection light emitted from the light emission unit and received by the light reception unit is substantially perpendicular to the conveyance direction, floating up of the paper from the conveyance surface being detected by detecting that the conveyed paper has shielded the detection light; and an air flow diverting guide member which is arranged in a periphery of the optical path and configured to prevent inflow of air having a temperature differential sufficient to affect the optical path.

According to this aspect of the present invention, it is possible to detect, with good accuracy, the floating height of the recording medium by suppressing the inflow to the periphery of the optical path of air that may affect the direction of the optical path of the detection light in an inkjet recording apparatus.

Preferably, the air flow diverting guide member includes a flat plate-shaped member which covers the optical path at an upper side of the optical path with respect to the conveyance surface.

According to this aspect of the present invention, it is possible to prevent the air flowing in upward toward the detection light path.

Preferably, the air flow diverting guide member includes a covering member which covers the optical path at an upper side of the optical path with respect to the conveyance surface, and an upstream side and a downstream side of the optical path in terms of the conveyance direction.

Preferably, the covering member has a guide surface which faces the conveyance surface and has a semicircular cylindrical groove through which the detection light passes formed therein through a whole width of the conveyance path.

According to these aspects of the present invention, it is possible to cover substantially the whole periphery of the optical path of the detection light, and therefore the inflow of air to the vicinity of the optical path is prevented and the height of the paper can be detected with good accuracy.

Preferably, the conveyance device includes a drum conveyance device which conveys the paper while holding the paper by attraction on a circumferential surface of a drum serving as the conveyance surface while gripping a leading end of the paper by a gripping device arranged on the circumferential surface of the drum; the light emission unit and the light reception unit are arranged on sides of the circumferential surface of the drum in such a manner that the optical path of the detection light is substantially parallel to an axial direction of the drum; and the covering member has a guide surface which faces the circumferential surface of the drum and has a semicircular cylindrical groove through which the detection light passes formed therein, and the covering member is arranged substantially in parallel with the axial direction of the drum.

According to this aspect of the present invention, it is possible accurately to detect floating of the recording medium conveyed by the drum conveyance device.

Preferably, the guide surface has a curvature to match a curvature of the circumferential surface of the drum.

According to this aspect of the present invention, the gap between the air flow diverting guide member and the circumferential surface of the drum is made as narrow as possible, and the inflow of air having a temperature differential can be prevented.

Preferably, the paper floating detection apparatus further comprises an air blowing device which blows air having substantially no temperature differential with respect to air in the periphery of the optical path, toward a space between the air flow diverting guide member and the conveyance surface.

According to this aspect of the present invention, it is possible further to prevent inflow of air having a temperature differential.

Preferably, the air flow diverting guide member has an air blowing aperture which connects an air blowing path of the air blowing device with the space between the air flow diverting guide member and the conveyance surface; and the air blowing device blows the air toward the conveyance surface through the air blowing aperture.

According to this aspect of the present invention, the air blowing device and the air flow diverting guide member are unified and it is possible to blow air efficiently.

Preferably, the air blowing aperture is arranged so that the air is blown onto the conveyance surface in a vicinity of the optical path.

Preferably, the air blowing aperture is arranged so that the air is blown onto the conveyance surface on the upstream side of the optical path in terms of the conveyance direction.

Preferably, the air blowing aperture is arranged so that the air is blown onto the conveyance surface on the downstream side of the optical path in terms of the conveyance direction.

According to these aspects of the present invention, by appropriately setting the position at which the air blowing is performed from the air blowing device, according to the state of the air flowing in from the exterior to the periphery of the optical path, it is possible to prevent the inflow of air having a temperature differential, more efficiently, and therefore highly accurate detection of floating can be achieved.

Preferably, the air flow diverting guide member and the air blowing device have a path through which the air blown from the air blowing device is circulated in order to suppress temperature difference between the conveyance device and the air blown from the air blowing device.

According to this aspect of the present invention, it is possible to suppress the occurrence of a temperature differential in the air in the periphery of the optical path by directing the air flow which has been blown once onto a member of the apparatus, such as the conveyance device, and has been changed in the temperature, and the air temperature in the periphery of the optical path can be kept substantially uniform.

In order to attain the aforementioned object, the present invention is also directed to a paper conveyance apparatus comprising the above-described paper floating detection apparatus.

According to this aspect of the present invention, it is possible to detect floating from the conveyance surface of the recording medium during conveyance, with good accuracy, and therefore it is possible to respond appropriately in the subsequent conveyance processes, if floating is detected.

In order to attain the aforementioned object, the present invention is also directed to an image recording apparatus comprising the above-described paper conveyance apparatus.

According to this aspect of the present invention, it is possible to detect floating of the recording medium from the conveyance surface during conveyance, and therefore good image quality can be maintained.

As described above, according to the present invention, it is possible to detect, with good accuracy, the floating height of the recording medium by suppressing the inflow to the periphery of the optical path of the detection light of air which may affect the direction of the optical path of the detection light in an inkjet recording apparatus.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
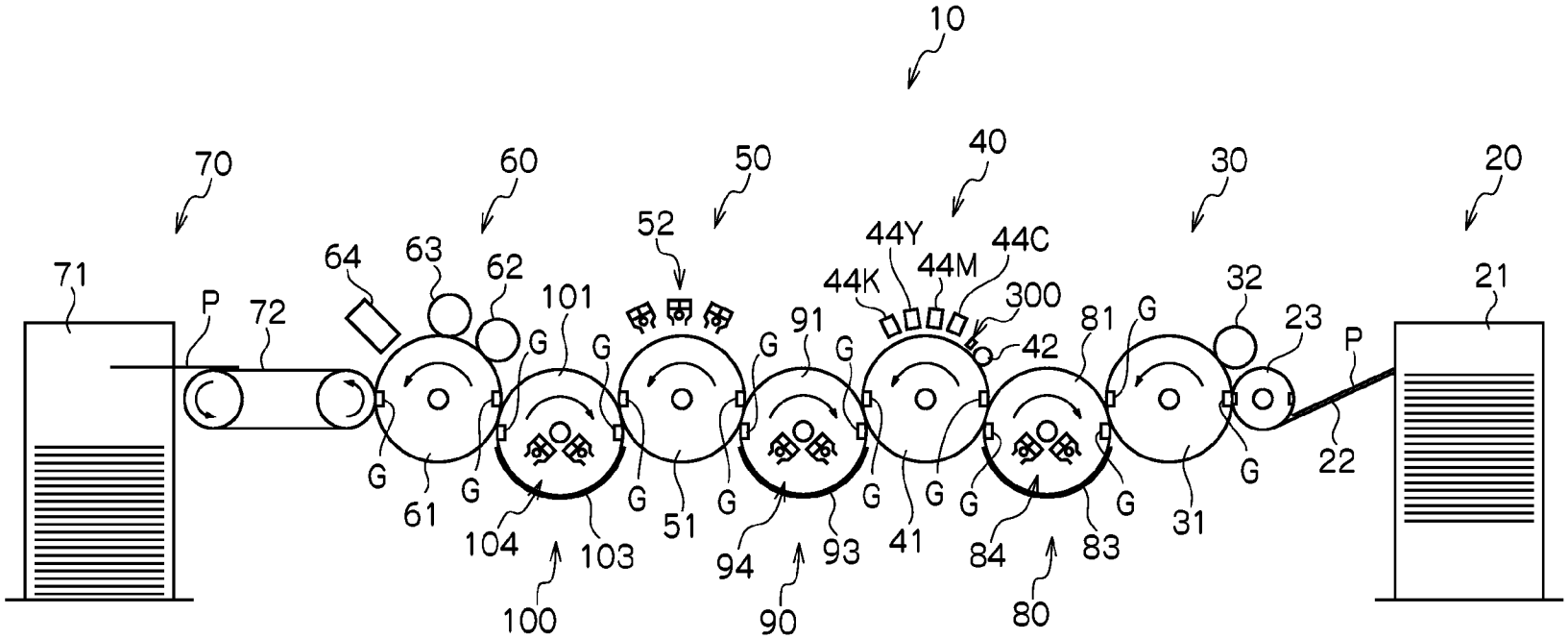
FIG. 1 is a schematic diagram showing the overall composition of an image recording apparatus which incorporates a paper conveyance apparatus including a paper floating detection apparatus according to an embodiment of the present invention.

FIG. 1 is a schematic diagram showing the overall composition of an image recording apparatus 10 which incorporates a paper conveyance apparatus including a paper floating detection apparatus according to an embodiment of the present invention.

As shown in FIG. 1, the image recording apparatus 10 in the present embodiment is an image formation apparatus which forms an image by an inkjet method onto cut sheet paper P (recording medium), using an aqueous ink (ink including water in the solvent). The image recording apparatus 10 includes: a paper supply unit 20, which supplies the paper P; a treatment liquid deposition unit 30, which deposits a prescribed treatment liquid onto a printing surface (image formation surface) of the paper P; an image recording unit 40, which forms a color image by ejecting and depositing droplets of ink of the respective colors of C (cyan), M (magenta), Y (yellow) and K (black) onto the printing surface of the paper P, from inkjet heads; an ink drying unit 50, which dries the ink droplets that have been deposited on the paper P; a fixing unit 60, which fixes the image recorded on the paper P; and a recovery unit 70, which recovers the paper P after printing.

Conveyance drums 31, 41, 51 and 61 are arranged respectively as conveyance devices of the paper P, in the treatment liquid deposition unit 30, the image recording unit 40, the ink drying unit 50 and the fixing unit 60. The paper P is conveyed through the treatment liquid deposition unit 30, the image recording unit 40, the ink drying unit 50 and the fixing unit 60, by means of these conveyance drums 31, 41, 51 and 61.

The conveyance drums 31, 41, 51 and 61 are formed to correspond to the paper width and rotate by being driven by motors (not illustrated) (in FIG. 1, the drums rotate in the counter-clockwise direction). Grippers G are arranged on the circumferential surface of each of the conveyance drums 31, 41, 51 and 61, and the paper P is conveyed with the leading end portion thereof being gripped by the gripper G. In the present embodiment, a composition is adopted in which the grippers G are arranged at two positions separated by 180° on the circumferential surface of each of the conveyance drums 31, 41, 51 and 61, in such a manner that two sheets of paper can be conveyed in one revolution.

Moreover, a plurality of suction holes are formed in the circumferential surface of each of the conveyance drums 31, 41, 51 and 61, and the rear surface of the paper P is held by suction through the suction holes, thereby securing the paper P by suction on the circumferential surface of each of the conveyance drums 31, 41, 51 and 61. In the present embodiment, the composition is adopted in which the paper P is held by suction on the outer circumferential surfaces of the conveyance drums 31, 41, 51 and 61, but it is also possible to adopt a composition in which the paper P is attracted electrostatically and held by attraction on the outer circumferential surfaces of the conveyance drums 31, 41, 51 and 61.

Transfer drums 80, 90 and 100 are disposed respectively between the treatment liquid deposition unit 30 and the image recording unit 40, between the image recording unit 40 and the ink drying unit 50, and between the ink drying unit 50 and the fixing unit 60. The paper P is conveyed between the respective units by means of these transfer drums 80, 90 and 100.

The transfer drums 80, 90 and 100 are composed by transfer drum main bodies 81, 91 and 101 constituted of frames, and grippers G which are arranged on the transfer drum main bodies 81, 91 and 101. The transfer drum main bodies 81, 91 and 101 are formed to correspond to the paper width and rotate by being driven by motors (not illustrated) (in FIG. 1, the drums rotate in the clockwise direction). By this means, the grippers G rotate on the same circular path. The paper P is conveyed with the leading end portion thereof being gripped by the gripper G In the present embodiment, a pair of grippers G are arranged at symmetrical positions about the axis of rotation of each of the transfer drums 80, 90 and 100, in such a manner that two sheets of paper P can be conveyed in one revolution.

Circular arc-shaped guide plates 83, 93 and 103 are arranged along the conveyance path of the paper P, below the transfer drums 80, 90 and 100. The paper P which is conveyed by the transfer drums 80, 90 and 100 is conveyed while the rear surface of the paper (the surface on the opposite side to the printing surface) is guided by the guide plates 83, 93 and 103.

Furthermore, dryers (hot air flow drying device) 84, 94 and 104 which blow hot air flow toward the paper P conveyed by the transfer drums 80, 90 and 100 are arranged inside the transfer drums 80, 90 and 100. The hot air flows blown out from the dryers 84, 94 and 104 during this conveyance process strike the printing surface of the paper P conveyed by the transfer drums 80, 90 and 100.

The paper P supplied from the paper supply unit 20 is transferred to the conveyance drum 31 of the treatment liquid deposition unit 30, and is then transferred from the conveyance drum 31 of the treatment liquid deposition unit 30 to the conveyance drum 41 of the image recording unit 40 through the transfer drum 80. The paper P is transferred from the conveyance drum 41 of the image recording unit 40 to the conveyance drum 51 of the ink drying unit 50 through the transfer drum 90, and is transferred from the conveyance drum 51 of the ink drying unit 50 to the conveyance drum 61 of the fixing unit 60 through the transfer drum 100. The paper P is then transferred from the conveyance drum 61 of the fixing unit 60 to the recovery unit 70. While passing through this series of conveyance steps, prescribed processes are carried out and an image is formed on the printing surface of the paper P.

The paper P is conveyed in such a manner that the printing surface is facing toward the outside on the conveyance drums 31, 41, 51 and 61, and the printing surface is facing toward the inside on the transfer drums 80, 90 and 100.

The composition of the respective units of the image recording apparatus 10 in the present embodiment is described in detail below.

<Paper Supply Unit>

The paper supply unit 20 includes a paper supply device 21, a paper supply tray 22 and a transfer drum 23, and supplies cut sheet paper P continuously, one sheet at a time, to the treatment liquid deposition unit 30.

The paper supply device 21 supplies the paper P stacked in a magazine (not illustrated), successively, one sheet at a time from the upper side, to the paper supply tray 22.

The paper supply tray 22 outputs the paper P supplied from the paper supply device 21 to the transfer drum 23.

The transfer drum 23 receives the paper P output from the paper supply tray 22, conveys the paper P along a prescribed conveyance path, and then transfers the paper P to the conveyance drum 31 of the treatment liquid deposition unit 30.

Versatile printing paper, which is not exclusively produced for inkjet printing, can be used as the paper P.

<Treatment Liquid Deposition Unit>

The treatment liquid deposition unit 30 deposits the treatment liquid onto the printing surface of the paper P. The treatment liquid deposition unit 30 includes a conveyance drum (hereinafter referred to as a treatment liquid deposition drum) 31, which conveys the paper P, and a treatment liquid deposition device 32, which deposits the treatment liquid onto the printing surface of the paper P conveyed by the treatment liquid deposition drum 31.

The treatment liquid deposition drum 31 receives the paper P from the transfer drum 23 of the paper supply unit 20 by gripping the leading end of the paper P with a gripper G, and conveys the paper P by rotating.

The treatment liquid deposition device 32 deposits the treatment liquid having a function of aggregating the coloring material in the ink onto the printing surface of the paper P conveyed by the treatment liquid deposition drum 31. The treatment liquid deposition device 32 is, for example, constituted as a coating device for applying the treatment liquid by a roller, which applies the treatment liquid to the printing surface of the paper P by abutting and pressing the coating roller bearing the treatment liquid on the circumferential surface thereof against the printing surface of the paper P. By previously depositing the treatment liquid and then depositing droplets of the ink, it is possible to suppress feathering, bleeding, and the like, and to perform printing of high quality, even when using generic printing paper. For the treatment liquid deposition device 32, it is also possible to adopt a composition which deposits the treatment liquid by using a droplet ejection head similar to the inkjet head described below, or a composition which deposits the treatment liquid by means of a spray.

According to the treatment liquid deposition unit 30 having the composition described above, the paper P is conveyed along a prescribed conveyance path by the treatment liquid deposition drum 31, and during this conveyance process, the treatment liquid is deposited onto the printing surface of the paper P from the treatment liquid deposition device 32. The paper P having the treatment liquid deposited on the printing surface thereof is then transferred from the treatment liquid deposition drum 31 to the transfer drum 80 at a prescribed position.

Here, as described above, the dryer 84 is arranged inside the transfer drum 80, and a hot air flow is blown toward the guide plate 83. The hot air flow is blown onto the printing surface of the paper P during the course of the conveyance of the paper P from the treatment liquid deposition unit 30 to the image recording unit 40 by the transfer drum 80, thereby drying the treatment liquid which has been deposited on the printing surface (namely, evaporating off the solvent component in the treatment liquid).

Furthermore, although not shown in the drawings, a separate cooling unit may be arranged here in such a manner that the paper P which has been heated by the heated air flow to dry the treatment liquid is cooled before image formation in the subsequent image recording unit, in order to prevent condensation.

<Image Recording Unit>

The image recording unit 40 forms a color image on the printing surface of the paper P by ejecting and depositing droplets of inks of the respective colors of C, M, Y and K onto the printing surface of the paper P. The image recording unit 40 includes: a conveyance drum (hereinafter referred to as an image recording drum) 41, which conveys the paper P; a paper pressing roller 42, which presses against the printing surface of the paper P conveyed by the image recording drum 41, thereby causing the rear surface of the paper P to make close contact with the circumferential surface of the image recording drum 41; a paper floating detection apparatus 300, which detects floating of the paper P passing the paper pressing roller 42; and the inkjet heads 44C, 44M, 44Y and 44K, which eject ink droplets of respective colors of C, M, Y and K toward the paper P.

The image recording drum 41 receives the paper P from the transfer drum 80 and conveys the paper P by rotating. In this case, as described above, the paper P is conveyed by being held by suction on the outer circumferential surface of the image recording drum 41. Therefore, a circular arc-shaped surface defined by the outer circumferential surface of the image recording drum 41 (the region from where the paper P is received from the transfer drum 80 to where the paper P is transferred to the transfer drum 90) is formed as a conveyance surface, and the paper P is conveyed along a conveyance path set on this conveyance surface. The conveyance path is set in accordance with the width of the paper P and passing through the center of the image recording drum 41.

The paper pressing roller 42 is disposed in the vicinity of the paper receiving position of the image recording drum 41 (the position where the paper P is received from the transfer drum 80), and is abutted and pressed against the circumferential surface of the image recording drum 41 by receiving a pressing force from a pressing mechanism (not illustrated). The paper P transferred from the transfer drum 80 to the image recording drum 41 is nipped by passing the paper pressing roller 42, and the rear surface of the paper P is thereby caused to make close contact with the outer circumferential surface of the image recording drum 41.

The paper floating detection apparatus 300 detects floating (more specifically, a prescribed amount of floating or more from the outer circumferential surface of the image recording drum 41) of the paper P passing the paper pressing roller 42. This paper floating detection apparatus 300 detects floating of the paper P by irradiating laser light (a detection light) across the image recording drum 41 at a position a predetermined height from the outer circumferential surface (conveyance surface) of the image recording drum 41, and detecting the presence or absence of shielding of the light. In other words, if floating of the paper P occurs, then the laser light is shielded by the paper P, and therefore floating of the paper P is detected by detecting the presence or absence of shielding of the laser light. The composition of this paper floating detection apparatus 300 is described in detail hereinafter.

The four inkjet heads 44C, 44M, 44Y and 44K are disposed after the paper floating detection apparatus 300 and are arranged at uniform intervals along the conveyance path of the paper P. Each of the inkjet heads 44C, 44M, 44Y and 44K is constituted of a line head corresponding to the paper width and ejects ink droplets of the corresponding color toward the image recording drum 41 from a nozzle row formed on a nozzle surface.

According to the image recording unit 40 having the composition described above, the paper P is conveyed along a prescribed conveyance path by the image recording drum 41. The paper P transferred from the transfer drum 80 to the image recording drum 41 is firstly nipped by the paper pressing roller 42 and caused to make close contact with the outer circumferential surface of the image recording drum 41. Thereupon, the presence or absence of floating of the paper P is determined by the paper floating detection apparatus 300, whereupon ink droplets of respective colors of C, M, Y and K are ejected and deposited onto the printing surface of the paper P from the inkjet heads 44C, 44M, 44Y and 44K, thereby forming a color image on the printing surface.

Here, in the image recording apparatus 10 according to the present embodiment, an aqueous ink composed by an ink in which thermoplastic resin particles have been dispersed is used for each color. Even if using the aqueous ink, since the treatment liquid is deposited on the paper P, then it is possible to form an image of high quality without giving rise to feathering, bleeding, or the like.

Furthermore, if floating of the paper P is detected by the paper floating detection apparatus 300, then conveyance is halted and a warning is issued.

The paper P on which the image is formed is transferred to the transfer drum 90 and is conveyed on a prescribed conveyance path by the transfer drum 90, and is transferred onto the conveyance drum 51 of the ink drying unit 50. As described above, the dryer 94 is arranged inside the transfer drum 90, and a hot air flow is blown toward the guide plate 93. An ink drying process is carried out in the ink drying unit 50 at a later stage, but the paper P also undergoes a drying process during conveyance by the transfer drum 90.

Although not shown in the drawings, the image recording unit 40 is provided with a maintenance unit which performs maintenance of the inkjet heads 44C, 44M, 44Y and 44K, and the inkjet heads 44C, 44M, 44Y and 44K are moved to the maintenance unit as and when necessary so as to be able to receive required maintenance.

<Ink Drying Unit>

The ink drying unit 50 dries the liquid component remaining on the paper P after the image recording. The ink drying unit 50 includes a conveyance drum (hereinafter referred to as an ink drying drum) 51, which conveys the paper P, and an ink drying device 52, which carries out the drying process on the paper P conveyed by the ink drying drum 51.

The ink drying drum 51 receives the paper P from the transfer drum 90 and conveys the paper P by rotating.

The ink drying device 52 is constituted of dryers (in this embodiment, three dryers are arranged along the paper P conveyance path), for example, and dries the ink (evaporates off the liquid component present on the paper P) by blowing a hot air flow toward the paper P conveyed by the ink drying drum 51.

In the ink drying unit 50 having the composition described above, the paper P is conveyed on the ink drying drum 51. During the course of this conveyance, a hot air flow is blown from the ink drying device 52 onto the printing surface of the paper P and the ink which has been deposited on the printing surface is dried.

The paper P that has passed through the ink drying device 52 is subsequently received onto the transfer drum 100 from the ink drying drum 51 at a prescribed position. The paper P is conveyed on a prescribed conveyance path by the transfer drum 100 and is transferred to the conveyance drum 61 of the fixing unit 60.

As described above, the dryer 104 is disposed inside the transfer drum 100 and blows a hot air flow toward the guide plate 103. Consequently, the paper P undergoes a drying process also during conveyance on the transfer drum 100.

<Fixing Unit>

The fixing unit 60 fixes the image which has been recorded on the printing surface of the paper P, by applying heat and pressure to the paper P. The fixing unit 60 includes: a conveyance drum (hereinafter referred to as a fixing drum) 61, which conveys the paper P; heat rollers 62 and 63, which apply heat and pressure to the paper P conveyed by the fixing drum 61; and an in-line sensor 64, which measures the temperature and humidity, and the like, of the paper P after forming the image and which captures the formed image.

The fixing drum 61 receives the paper P from the transfer drum 100 and conveys the paper P by rotating.

The heat rollers 62 and 63 apply heat and pressure to the ink that has been deposited on the printing surface of the paper P, thereby melting the thermoplastic resin dispersed in the ink and causing the ink to form a film, and also correcting deformation such as cockling, curl, and the like, which has occurred in the paper P. The heat rollers 62 and 63 are formed to substantially the same width as the fixing drum 61, and are heated to a prescribed temperature by the heaters arranged therein. Furthermore, the heat rollers 62 and 63 are abutted and pressed against the circumferential surface of the fixing drum 61 with a prescribed pressing force, by means of a pressing device, which is not illustrated. When the paper P passes the heat rollers 62 and 63, the paper P is heated and pressed by the heat rollers 62 and 63.

The in-line sensor 64 includes a temperature meter, a humidity meter, and a CCD line sensor, and the like, and measures the temperature and humidity, and the like, of the paper P conveyed by the fixing drum 61, as well as capturing the image formed on the paper P. Abnormalities in the apparatus and head ejection defects, and the like, are checked on the basis of the determination results of the in-line sensor 64.

According to the fixing unit 60 having the composition described above, the paper P is conveyed by the fixing drum 61, and the heat rollers 62 and 63 are abutted and pressed against the printing surface during the course of this conveyance, thereby applying heat and pressure to the paper P. By this means, the thermoplastic resin dispersed in the ink is melted and the ink forms a film, and the deformation which has occurred in the paper P is corrected.

The paper P which has undergone the fixing process is transferred from the fixing drum 61 to the recovery unit 70 at a prescribed position.

<Recovery Unit>

The recovery unit 70 recovers the paper P which has undergone the series of printing processes, and stacks the paper P in a stacker 71. The recovery unit 70 includes the stacker 71 which recovers the paper P, and a paper output conveyor 72, which receives the paper P that has undergone the fixing process in the fixing unit 60, from the fixing drum 61, conveys the paper P on a prescribed conveyance path, and outputs the paper P to the stacker 71.

The paper P which has undergone the fixing process in the fixing unit 60 is transferred onto the paper output conveyor 72 from the fixing drum 61, conveyed by the paper output conveyor 72 up to the stacker 71, and then recovered in the stacker 71.

Next, the control system of the image recording apparatus 10 in the present embodiment is explained below.

Figure 2:
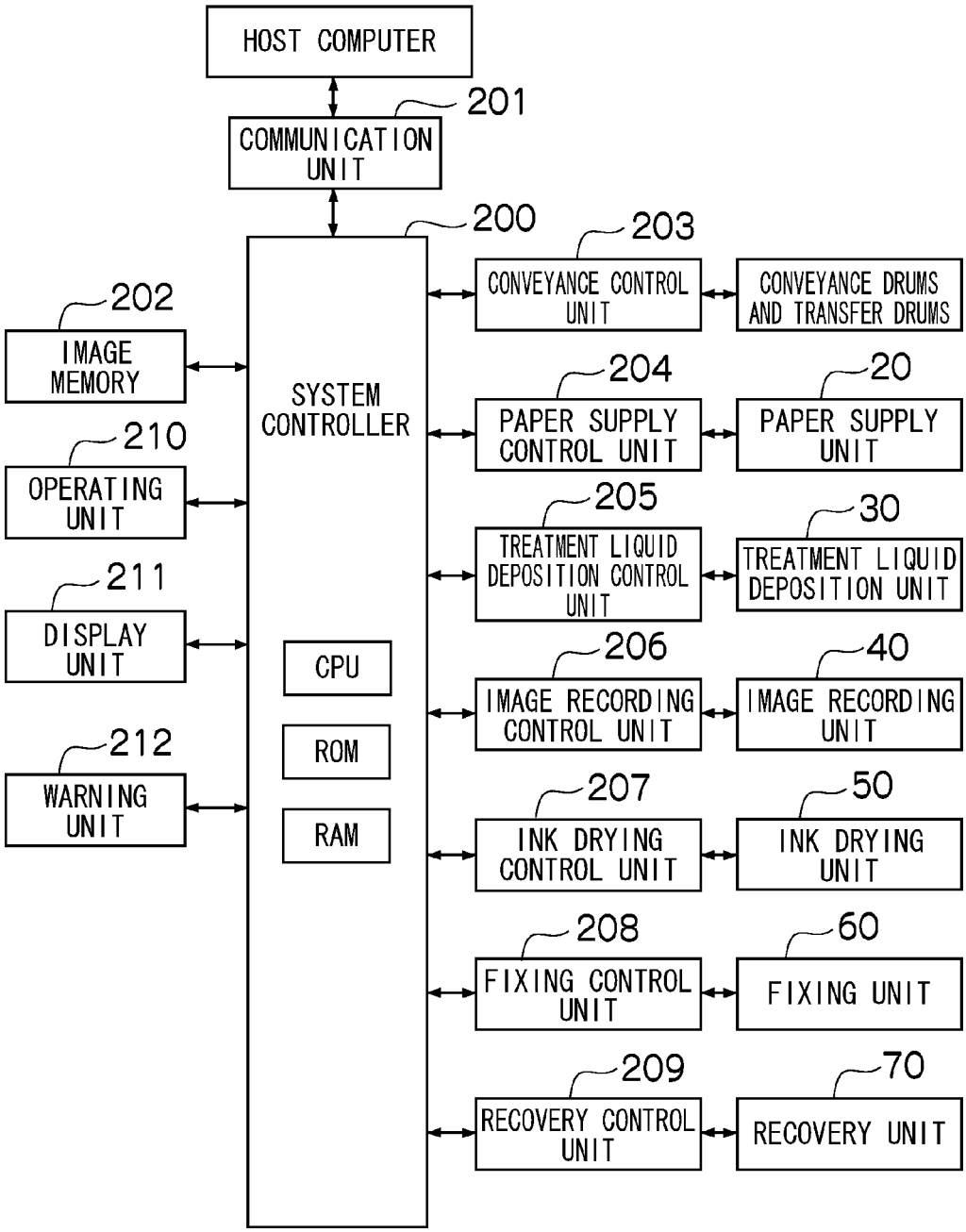
FIG. 2 is a block diagram showing the composition of a control system of the image recording apparatus according to the present embodiment.

FIG. 2 is a block diagram showing the approximate composition of a control system of an image recording apparatus 10 according to the present embodiment.

As shown in FIG. 2, the image recording apparatus 10 includes a system controller 200, a communication unit 201, an image memory 202, a conveyance control unit 203, a paper supply control unit 204, a treatment liquid deposition control unit 205, an image recording control unit 206, an ink drying control unit 207, a fixing control unit 208, a recovery control unit 209, an operating unit 210, a display unit 211, a warning unit 212, and the like.

The system controller 200 functions as a control device which performs overall control of the respective units of the image recording apparatus 10, and also functions as a calculation device which performs various calculation processes. The system controller 200 includes a CPU, ROM, RAM and the like, and operates in accordance with a prescribed control program. Control programs executed by the system controller 200 and various data necessary for control purposes are stored in the ROM.

The communication unit 201 includes a prescribed communication interface, and sends and receives data between the communication interface and a connected host computer.

The image memory 202 functions as a temporary storage device for various data including image data, and data is read from and written to the memory via the system controller 200. Image data which has been read in from the host computer through the communication unit 201 is stored in the image memory 202.

The conveyance control unit 203 controls the driving of the conveyance drums 31, 41, 51 and 61 and the transfer drums 80, 90 and 100, which are conveyance devices of the paper P in the treatment liquid deposition unit 30, the image recording unit 40, the ink drying unit 50 and the fixing unit 60.

More specifically, as well as controlling the driving of the motors which drive the conveyance drums 31, 41, 51 and 61, the conveyance control unit 203 also controls the opening and closing of the grippers G which are arranged on the conveyance drums 31, 41, 51 and 61.

Similarly, as well as controlling the driving of the motors which drive the transfer drums 80, 90 and 100, the conveyance control unit 203 also controls the opening and closing of the grippers G which are arranged on the transfer drums 80, 90 and 100.

Moreover, since the conveyance drums 31, 41, 51 and 61 are provided with the mechanisms for attracting and holding the paper P on the circumferential surfaces, then the conveyance control unit 203 also controls the driving of the attracting and holding mechanisms (in the present embodiment, since the paper P is held by suction by vacuum, then the conveyance control unit 203 controls the driving of the vacuum pump which serves as the negative pressure generating device).

Furthermore, since the transfer drums 80, 90 and 100 are provided with the dryers 84, 94 and 104, then the conveyance control unit 203 also controls the driving (amount of heating and air flow volume) of the dryers 84, 94 and 104.

The driving of the conveyance drums 31, 41, 51 and 61 and the transfer drums 80, 90 and 100 is controlled in accordance with instructions from the system controller 200.

The paper supply control unit 204 controls the driving of the respective units which constitute the paper supply unit 20 (the paper supply device 21, the transfer drum 23, and the like), in accordance with instructions from the system controller 200.

The treatment liquid deposition control unit 205 controls the driving of the respective units (for example, the treatment liquid deposition device 32) which constitute the treatment liquid deposition unit 30, in accordance with instructions from the system controller 200.

The image recording control unit 206 controls the driving of the respective units which constitute the image recording unit 40 (the paper pressing roller 42, the inkjet heads 44C, 44M, 44Y and 44K, and the like) in accordance with instructions from the system controller 200.

The ink drying control unit 207 controls the driving of the respective units which constitute the ink drying unit 50 (the ink drying device 52, and the like), in accordance with instructions from the system controller 200.

The fixing control unit 208 controls the driving of the respective units which constitute the fixing unit 60 (the heat rollers 62 and 63, the in-line sensor 64, and the like), in accordance with instructions from the system controller 200.

The recovery control unit 209 controls the driving of the respective units (for example, the paper output conveyor 72)

which constitute the recovery unit 70, in accordance with instructions from the system controller 200.

The operating unit 210 includes a prescribed operating device (for example, operating buttons and a keyboard, a touch panel, or the like), and outputs operational information input from the operating device to the system controller 200. The system controller 200 executes various processing in accordance with the operational information input from the operating unit 210.

The display unit 211 includes a prescribed display device (for example, an LCD panel, or the like), and causes prescribed information to be displayed on the display device in accordance with instructions from the system controller 200.

The warning unit 212 includes a warning light and a speaker, and the like, and carries out a prescribed warning operation (flashing the warning light, issuing a warning sound from the speaker, or the like), in accordance with instructions from the system controller 200.

As described above, the image recording unit 40 is provided with the paper floating detection apparatus 300 to detect floating up of the paper P. The detection result for floating of the paper P obtained through the paper floating detection apparatus 300 is output to the system controller 200. When floating of the paper P is detected, the system controller 200 judges that a conveyance abnormality has occurred and instructs the conveyance control unit 203 to halt conveyance of the paper P, as well as instructing the warning unit 212 to issue a prescribed warning.

As described above, image data to be recorded on the paper P is sent to the image recording apparatus 10 from the host computer through the communication unit 201 and is stored in the image memory 202. The system controller 200 generates dot data by carrying out prescribed signal processing on the image data stored in the image memory 202, and records an image represented by this image data by controlling the driving of the inkjet heads of the image recording unit 40 in accordance with the generated dot data.

In general, the dot data is generated by subjecting the image data to color conversion processing and halftone processing. The color conversion processing is processing for converting image data represented by sRGB, or the like (for example, RGB 8-bit image data) into ink volume data for each color of ink used by the image recording apparatus 10 (in the present embodiment, ink volume data for the respective colors of C, M, Y, K). Halftone processing is processing for converting the ink volume data of the respective colors generated by the color conversion processing into dot data of respective colors by error diffusion processing, or the like.

The system controller 200 generates dot data of the respective colors by applying color conversion processing and halftone processing to the image data. An image represented by the image data is recorded on the paper P by controlling the driving of the corresponding inkjet heads in accordance with the dot data for the respective colors thus generated.

Next, a printing (image formation) operation of the image recording apparatus 10 described above is explained.

When the system controller 200 outputs a paper supply instruction to the paper supply device 21, paper P is supplied from the paper supply device 21 to the paper supply tray 22. The paper P supplied to the paper supply tray 22 is transferred to the treatment liquid deposition drum 31 of the treatment liquid deposition unit 30 through the transfer drum 23.

The paper P transferred onto the treatment liquid deposition drum 31 is conveyed along the prescribed conveyance path by the treatment liquid deposition drum 31, and during the course of this conveyance, the paper P passes through the treatment liquid deposition device 32 and the treatment liquid is deposited on the printing surface of the paper P.

The paper P on which the treatment liquid has been deposited is transferred from the treatment liquid deposition drum 31 to the transfer drum 80, conveyed on the prescribed conveyance path by the transfer drum 80, and then transferred to the image recording drum 41 of the image recording unit 40. During the course of conveyance by the transfer drum 80, a hot air flow is blown onto the printing surface of the paper P from the dryer 84 disposed inside the transfer drum 80, and the treatment liquid which has been deposited on the printing surface of the paper P is dried. As mentioned above, the paper P may be cooled by the cooling unit here once.

The paper P transferred from the transfer drum 80 to the image recording drum 41 is firstly nipped by the paper pressing roller 42 by passing the paper pressing roller 42, thereby causing the paper P to make close contact with the outer circumferential surface of the image recording drum 41. Thereupon, the presence or absence of floating up of the paper P is determined by the paper floating detection apparatus 300. Here, if floating up of the paper P is detected, it is determined that a conveyance abnormality of the paper P has occurred, and the conveyance is halted and a prescribed warning is issued. On the other hand, if no floating up of the paper P is detected, then the conveyance is continued without alteration and ink droplets of the respective colors of CMYK are ejected from the respective inkjet heads 44C, 44M, 44Y and 44K. By this means, a color image is recorded on the printing surface of the paper P. The paper P on which the image has been formed is received onto the transfer drum 90 from the image recording drum 41.

The paper P which has been transferred to the transfer drum 90 is conveyed on the prescribed conveyance path by the transfer drum 90, and is transferred onto the ink drying drum 51 of the ink drying unit 50. During the course of this conveyance, a hot air flow is blown onto the printing surface of the paper P from the dryer 94 disposed inside the transfer drum 90, and the ink which has been deposited on the printing surface of the paper P is dried.

The paper P which has been transferred to the ink drying drum 51 is conveyed along the prescribed conveyance path by the ink drying drum 51, and in the course of this conveyance, a hot air flow is blown onto the printing surface of the paper P from the ink drying device 52, thereby drying the liquid component remaining on the printing surface of the paper P.

The paper P which has undergone the drying process is transferred from the ink drying drum 51 to the transfer drum 100, conveyed along the prescribed conveyance path, and transferred to the fixing drum 61 of the fixing unit 60. During the course of conveyance by the transfer drum 100, a hot air flow is blown onto the printing surface of the paper P from the dryer 104 disposed inside the transfer drum 100, thereby further drying the ink which has been deposited on the printing surface of the paper P.

The paper P which has been transferred to the fixing drum 61 is conveyed along the prescribed conveyance path by the fixing drum 61, and during the course of this conveyance, the paper P is heated and pressed by the heat rollers 62 and 63, and thereby the image formed on the printing surface of the paper P is fixed. The paper P is then transferred onto the paper output conveyor 72 of the recovery unit 70 from the fixing drum 61, conveyed by the paper output conveyor 72 up to the stacker 71, and then output into the stacker 71.

As described above, in the image recording apparatus 10 in the present embodiment, the paper P is conveyed on the drums and during the course of this conveyance, the respective processes of treatment liquid deposition and drying, ejection and deposition of ink droplets, drying, and fixing are carried out on the paper P, thereby recording a prescribed image on the paper P.

The detection of paper floating is more specifically described below.

As described above, in the image recording apparatus 10 according to the present embodiment, the paper floating detection apparatus 300 is incorporated in the image recording unit 40, and floating up of the paper P is detected before ejection of ink droplets. Firstly, the optical system of the paper floating detection apparatus 300 is described.

Figure 3:
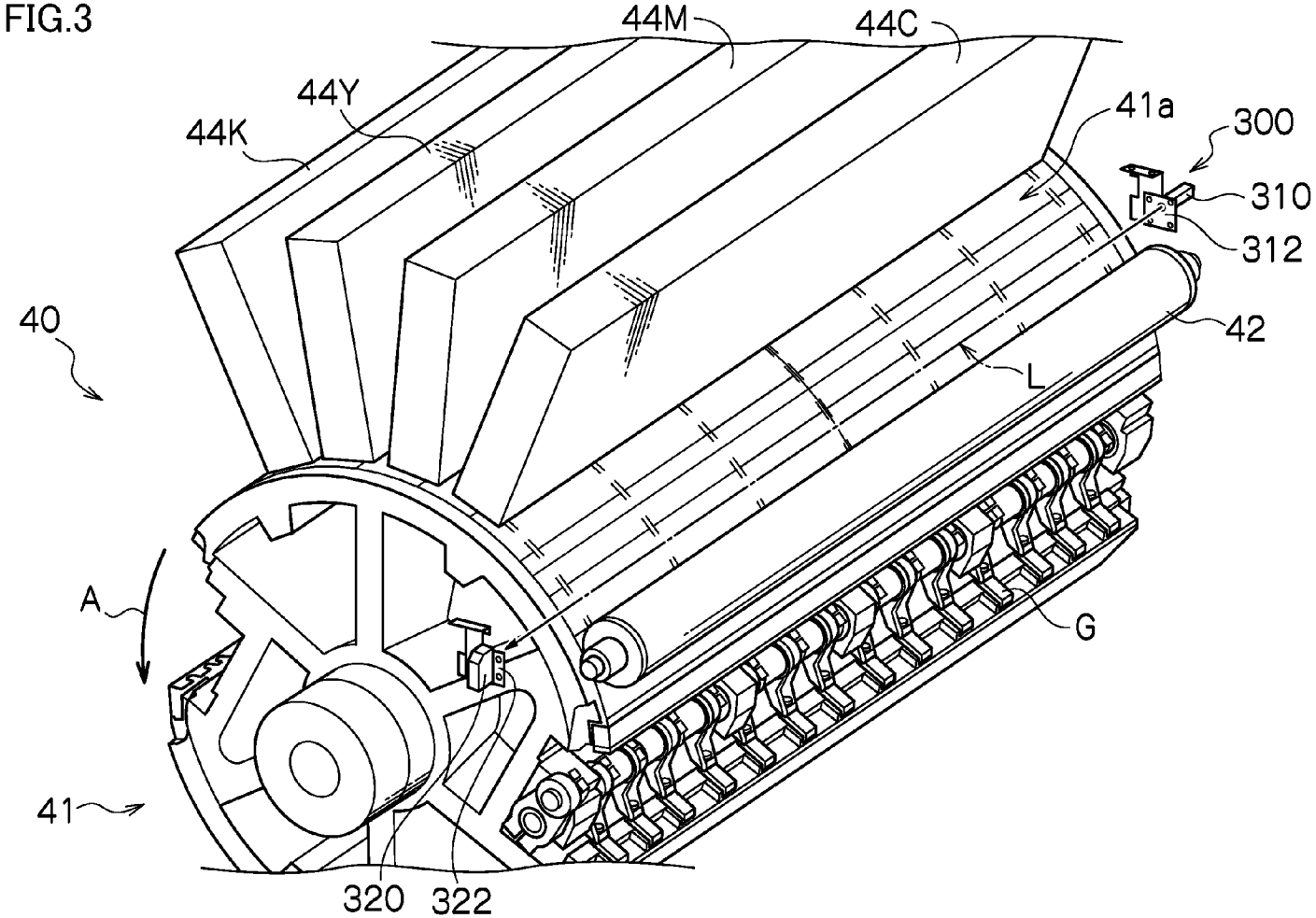
FIG. 3 is a perspective diagram showing an optical system of the paper floating detection apparatus is arranged in the image recording unit.

FIG. 3 is a perspective diagram showing the optical system of the paper floating detection apparatus 300 arranged in the image recording unit 40. As shown in FIG. 3, the image recording unit 40 is composed by arranging the inkjet heads 44C, 44M, 44Y and 44K so as to face the conveyance surface 41*a* of the image recording drum 41. The leading end of the paper P (not illustrated) is gripped by the grippers G, which are arranged in the axial direction of the image recording drum 41 at a recording medium transfer position of the image recording drum 41, and the paper P is conveyed in the drum rotation direction (conveyance direction), which is indicated with an arrow A in FIG. 3. Furthermore, the paper pressing roller 42 is arranged immediately before and to the upstream side of the inkjet heads 44C, 44M, 44Y and 44K in terms of the conveyance direction of the paper P, and the paper P to be conveyed immediately below the inkjet heads 44C, 44M, 44Y and 44K is kept in a flat state without floating up from the conveyance surface 41*a*.

The paper floating detection apparatus 300 includes a light emission unit 310 and a light reception unit 320, which are arranged between the paper pressing roller 42 and the inkjet heads 44C, 44M, 44Y and 44K so as to face each other in the axial direction across a space over the conveyance surface 41*a*, immediately after the paper pressing roller 42 and to the downstream side thereof in terms of the conveyance direction of the paper P.

The light emission unit 310 is installed on a main body frame (bar 350 described later, see FIG. 11) of the image recording apparatus 10 through a bracket, which is not illustrated. The light emission unit 310 includes a light emitting element and emits a detection light L from the light emitting element toward the light reception unit 320.

The detection light L is emitted substantially in parallel with the axis of rotation (drum axis) of the image recording drum 41 (namely, a direction substantially perpendicular to the conveyance direction of the paper P), as well as being emitted so as to pass through a position at a prescribed height from the outer circumferential surface (conveyance surface) 41*a* of the image recording drum 41. This prescribed height is specified in advance in accordance with the type and thickness of the paper P, and the like. The light emission unit 310 is disposed so as to satisfy these prescribed conditions. Furthermore, the system controller 200 controls the driving of the light emission unit 310 so as to control the emission of the detection light L.

On the other hand, the light reception unit 320 is installed on the main body frame of the image recording apparatus 10 through a bracket, which is not illustrated. The light reception unit 320 includes a light receiving element (for example, a transmissive photoelectric element) and the detection light L emitted from the light emission unit 310 is received by this light receiving element. The light receiving element is arranged so as to face the light emitting element of the light emission unit 310 and receives the detection light L which is emitted from the light emitting element in parallel with the axis of rotation of the image recording drum 41 and in a position at a prescribed height from the outer circumferential surface of the image recording drum 41.

Furthermore, aperture members 312 and 322 each having apertures are arranged respectively before the light emitting element of the light emission unit 310 and the light receiving element of the light reception unit 320. Paper floating is detected by detecting that the light between the apertures in the aperture members 312 and 322 (the detection light L) has been shielded by the paper P.

The light reception information (amount of light received) of the detection light L obtained by the light reception unit 320 is output to the system controller 200. The system controller 200 judges the presence or absence of floating of the paper P on the basis of the light reception information of the detection light L obtained by the light reception unit 320. More specifically, the amount of light received is compared with a previously specified threshold value, and if the amount of light received is lower than the threshold value, then it is judged that the detection light L has been shielded by the paper P and hence it is judged that floating of the paper P has occurred.

In a case where paper floating has been detected, a detection signal is output, a warning is issued, or a brake command, or the like, is issued to halt conveyance.

As described above, the heating units and the cooling units are installed separately on the main body of the image recording apparatus 10, and air having a temperature differential which is produced by these units flows to the optical path of the detection light L for detecting paper floating on the conveyance surface 41*a* of the image recording drum 41 shown in FIG. 3. When the air of greatly different temperature to the paper P and the conveyance surface 41*a* traverses the optical path of the detection light L, the optical path is bent by the air having the temperature differential due to varying atmospheric refraction in the optical path, and it may be difficult to determine floating of the paper P at the correct height.

Therefore, in the paper floating detection apparatus 300 according to a first embodiment of the present invention, an air flow diverting guide member which covers the optical path of the detection light L is arranged in order to prevent the hot air flow or cold air flow which travel from the heating units and the cooling units from arriving directly at the optical path of the detection light L.

Figure 4:
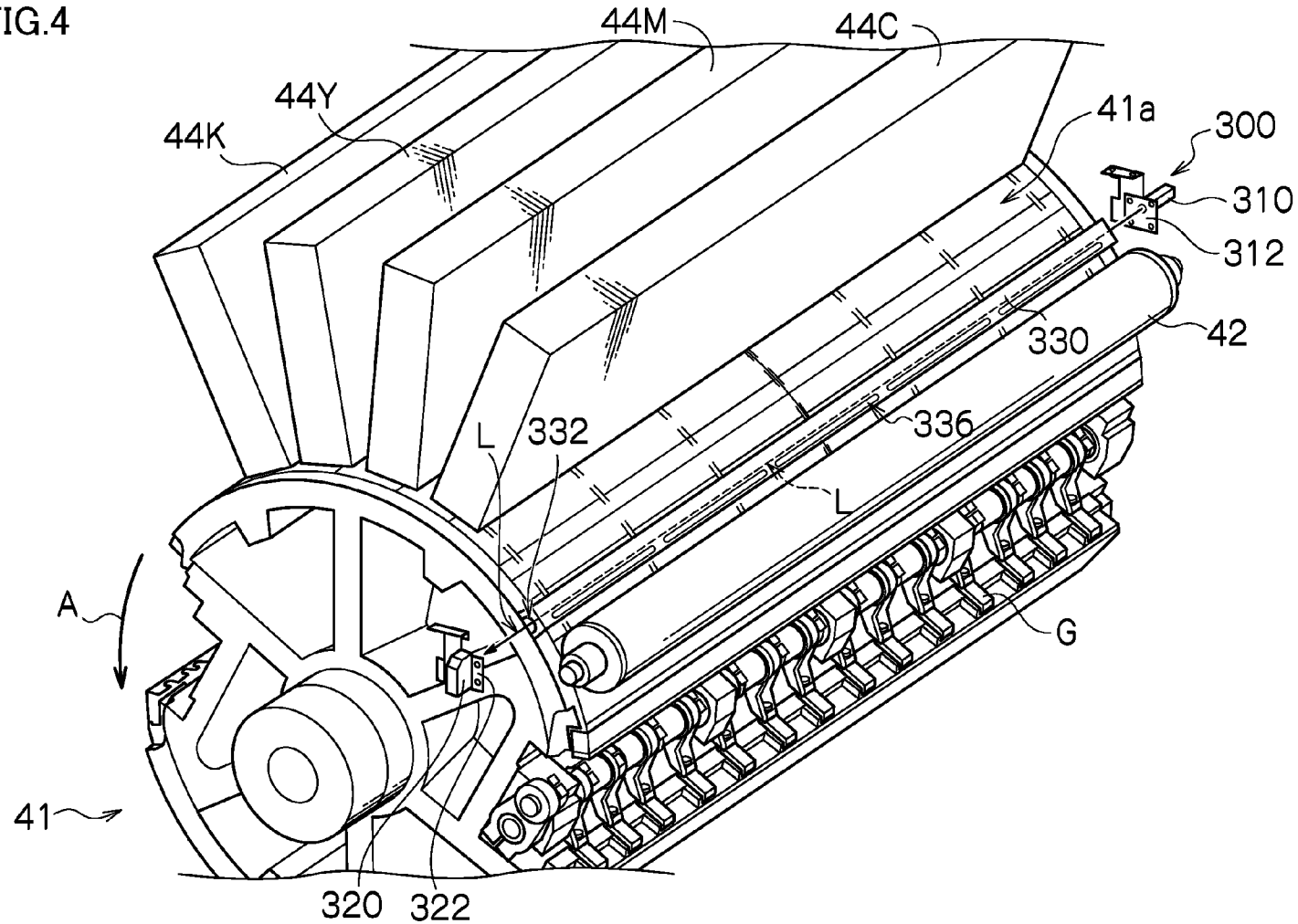
FIG. 4 is a perspective diagram showing a mode of arrangement of an air flow diverting guide member which covers an optical path of detection light.

FIG. 4 is a perspective diagram showing a mode of arrangement of the air flow diverting guide member which covers the optical path of the detection light L. As shown in FIG. 4, the air flow diverting guide member 330 is arranged to face the conveyance surface 41*a* of the image recording drum 41, so as to cover the optical path of the detection light L on the conveyance surface 41*a* from end to end in the drum axis direction. The air flow diverting guide member 330 is a substantially parallelepiped-shaped member in which a semicircular cylindrical groove 332 is formed from end to end in the drum axis direction in the surface on the side facing the conveyance surface 41*a*, in such a manner that the detection light L passes through the semicircular cylindrical groove 332.

The detection light L emitted from the light emitting element of the light emission unit 310 passes through the aperture of the aperture member 312, the semicircular groove 332 of the air flow diverting guide member 330 and the aperture of the aperture member 322, and is received by the light receiving element of the light reception unit 320.

Figure 5:
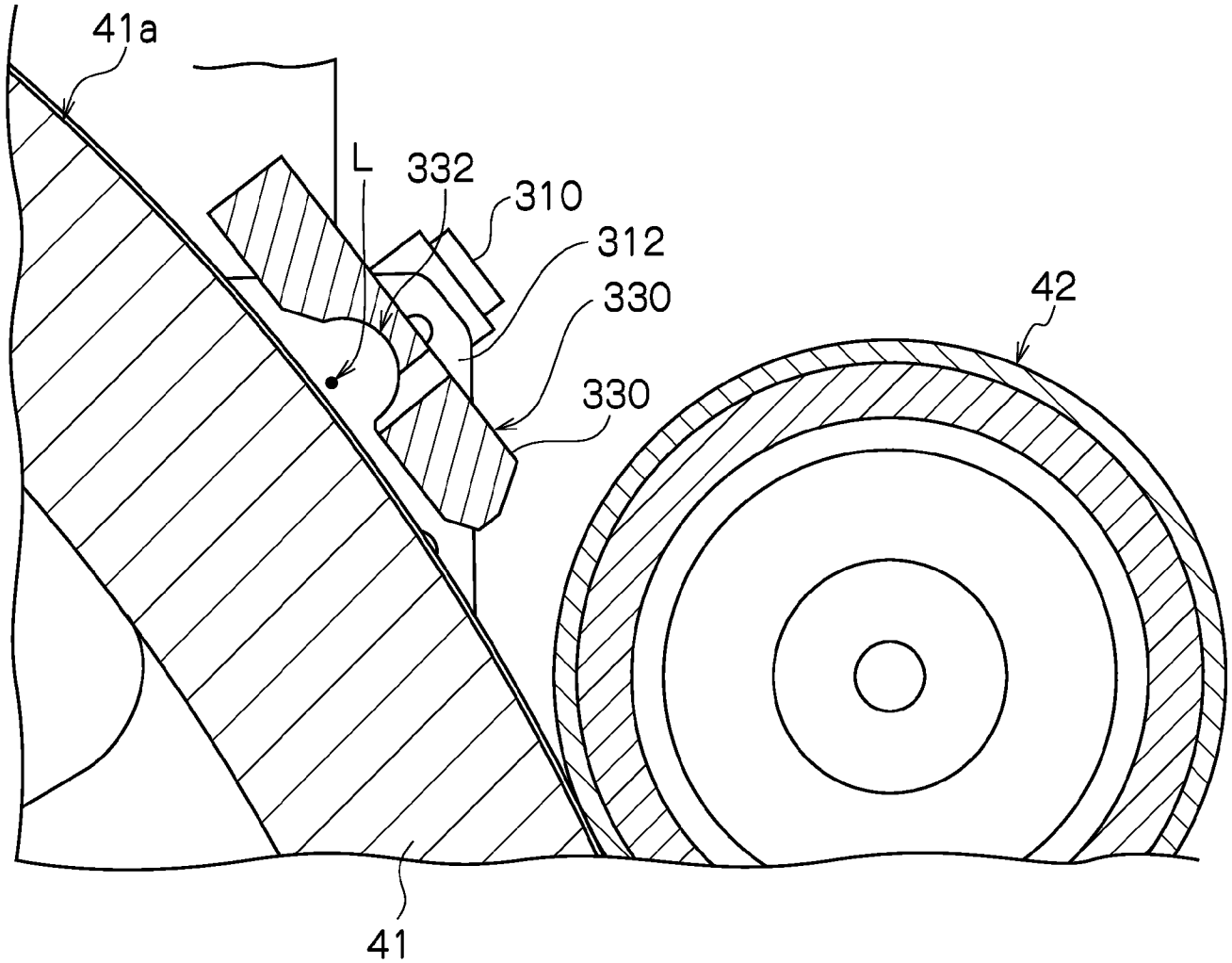
FIG. 5 is a cross-sectional diagram showing the air flow diverting guide member viewed from the side of a light reception unit.

FIG. 5 shows a cross-sectional diagram of the air flow diverting guide member 330 as viewed from the side of the light reception unit. As shown in FIG. 5, the air flow diverting guide member 330 is disposed at a slight clearance above the conveyance surface 41*a* of the image recording drum 41, and the semicircular cylindrical groove 332 having a semicircular cross-section is formed in a portion of the air flow diverting guide member 330 where the optical path of the detection light L passes.

The reason for forming the portion where the detection light L passes on the inner side of the air flow diverting guide member 330 in the semicircular shape is because, if the air flow diverting guide member 330 is formed in a flat plate shape which covers only the upper portion of the detection light L, then although it is possible to prevent an air flow from above, a space is required above the conveyance surface 41*a* in order to prevent reflection of the detection light L, and therefore the open height between the air flow diverting guide member and the conveyance surface 41*a* on the upstream and downstream sides in terms of the conveyance direction of the paper P becomes large, a large amount of air flows through the optical path of the detection light L, and hence little beneficial effect is obtained in providing the air flow diverting guide member, if the air flow diverting guide member has a flat plate shape.

Therefore, in the present embodiment, the side where the detection light L passes on the inner side of the air flow diverting guide member 330 is formed in the semicircular cylindrical shape, and the open heights between the air flow diverting guide member 330 and the conveyance surface 41*a* at the upstream side and downstream side in terms of the direction of conveyance, are kept to minimum, thereby reducing the inflow of air. Here, the minimum height is a distance specified by taking account of the amount of floating including the thickness of the paper P from the conveyance surface 41*a*, and the amount of positional variation in the air flow diverting guide member 330 which is produced by the composition of the parts.

In FIG. 5, the light reception unit 320 and the aperture member 322 which are present to the front side of the drawing are not depicted, and the light emission unit 310 and the aperture member 312 are viewed looking toward the air flow diverting guide member 330.

As described above, in the present embodiment, the optical path of the detection light L is covered by the air flow diverting guide member 330, and it is thus possible to detect the height of floating of the paper P with good accuracy, without being affected by the flow of air at a different temperature.

The air flow diverting guide member 330 shown in FIG. 5 has the guide surface of a flat shape on the lower side thereof facing the conveyance surface 41*a* on the upstream side and the downstream side of the semicircular groove 332 in terms of the conveyance direction of the paper P, but if the image recording drum 41 has a small diameter, then the curvature of the conveyance surface 41*a* is large and hence there is a large opening on the upstream side and the downstream side in the conveyance direction of the paper P if the guide surface on the lower side of the air flow diverting guide member 330 is flat.

Figure 6:
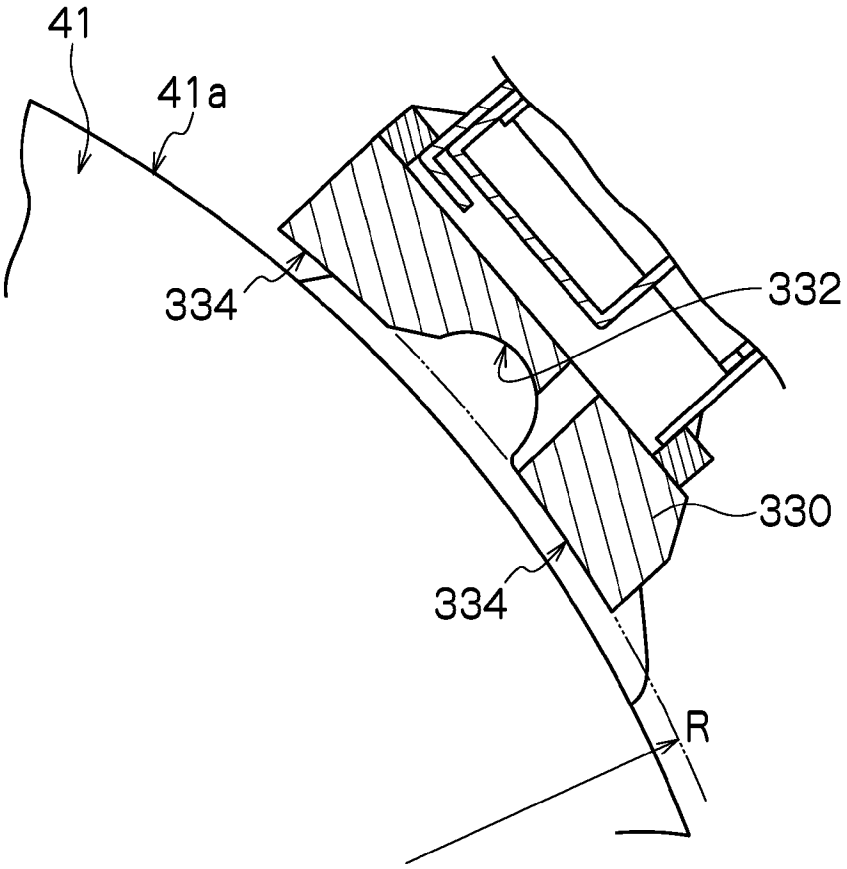
FIG. 6 is a cross-sectional diagram showing a guide surface of the lower side of the air flow diverting guide member having a curvature matching a curvature of a drum.

Therefore, as shown in FIG. 6, if the image recording drum 41 has a small diameter, then the guide surfaces 334 on the lower side of the air flow diverting guide member 330 are desirably formed with a curved shape having the radius of curvature R that matches the curvature of the conveyance surface 41*a* of the image recording drum 41.

Next, a second embodiment of the paper floating detection apparatus according to the present invention is described.

The second embodiment responds to cases where it is not easy to prevent the effects caused by air having a temperature differential entering into the optical path of the detection light L, even if using the air flow diverting guide member in which the semicircular groove is formed as in the embodiment described above, by blowing air having no temperature differential in the vicinity of the conveyance surface into the semicircular cylindrical groove and causing the blown air to exit from upstream side and downstream side gaps between the lower surface (guide surface 334) of the air flow diverting guide member and the conveyance surface, so as to keep the temperature in the periphery of the optical path of the detection light L as uniform as possible.

Figure 7:
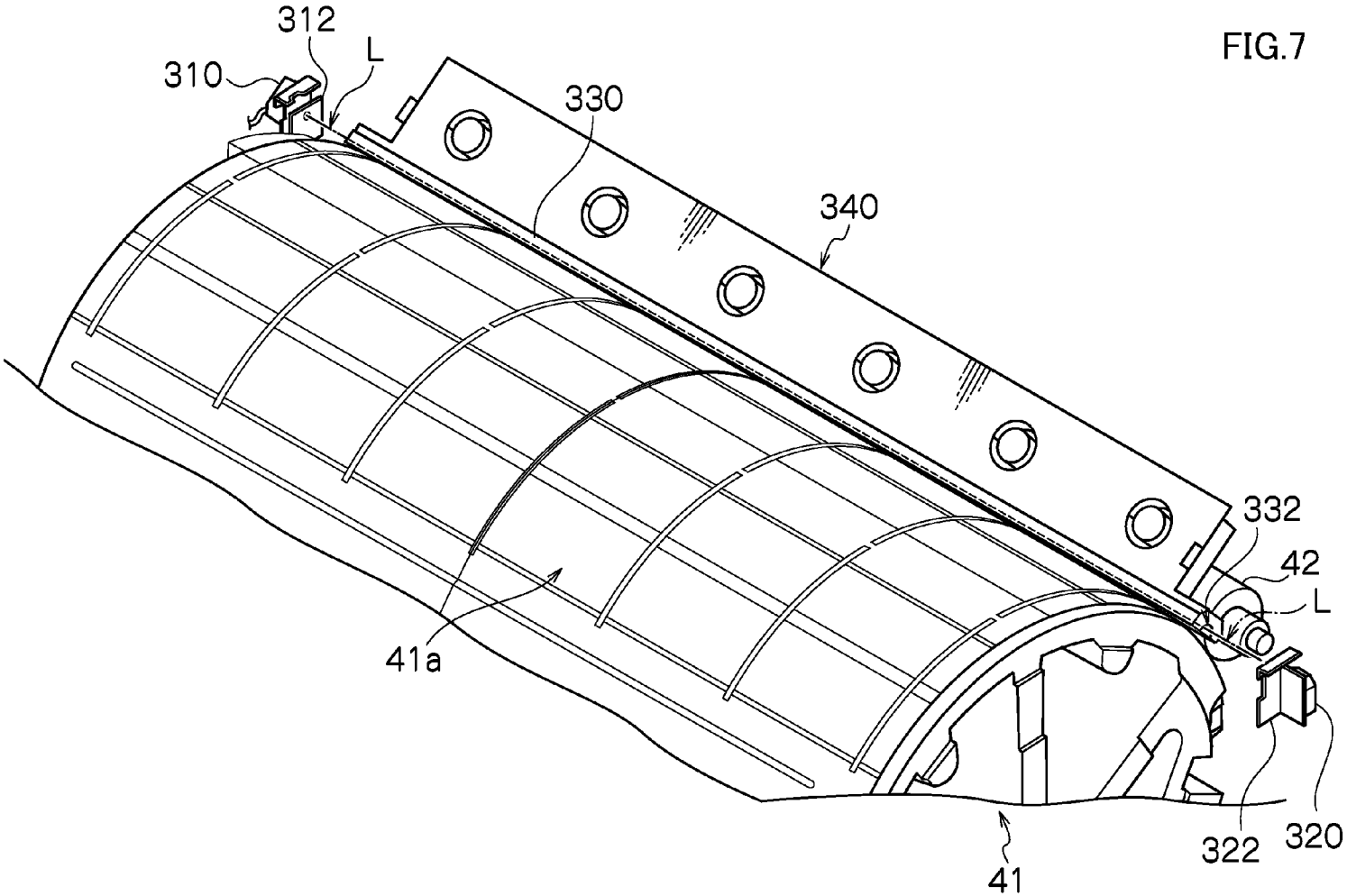
FIG. 7 is a perspective diagram showing a paper floating detection apparatus according to a second embodiment of the present invention.

FIG. 7 shows an approximate view of the paper floating detection apparatus in the second embodiment. FIG. 7 is a schematic diagram showing the paper floating detection apparatus which is arranged between the paper pressing roller 42 and the inkjet heads 44C, 44M, 44Y and 44K so as to face the conveyance surface 41*a* of the image recording drum 41, as viewed from the side of the inkjet heads 44C, 44M, 44Y and 44K. In FIG. 7, the illustration of the inkjet heads 44C, 44M, 44Y and 44K is omitted in order to make the drawing easier to understand.

As shown in FIG. 7, the light emission unit 310 and the aperture member 312, and the light receiving unit 320 and the aperture member 322 are disposed on either side of the conveyance surface 41*a* of the image recording drum 41 in the axial direction of the drum, and the air flow diverting guide member 330 is arranged to cover the optical path of the detection light L therebetween.

In the paper floating detection apparatus according to the present embodiment, a fan unit 340 for blowing air into the space inside the semicircular cylindrical groove 332 through which the detection light L passes is installed on the air flow diverting guide member 330.

The fan unit 340 is installed on the upper side of the air flow diverting guide member 330 with respect to the whole of the air flow diverting guide member 330, so as to blow air inside the semicircular cylindrical groove 332 of the air flow diverting guide member 330 by means of an air blowing fan arranged inside the fan unit 340.

Figure 8:
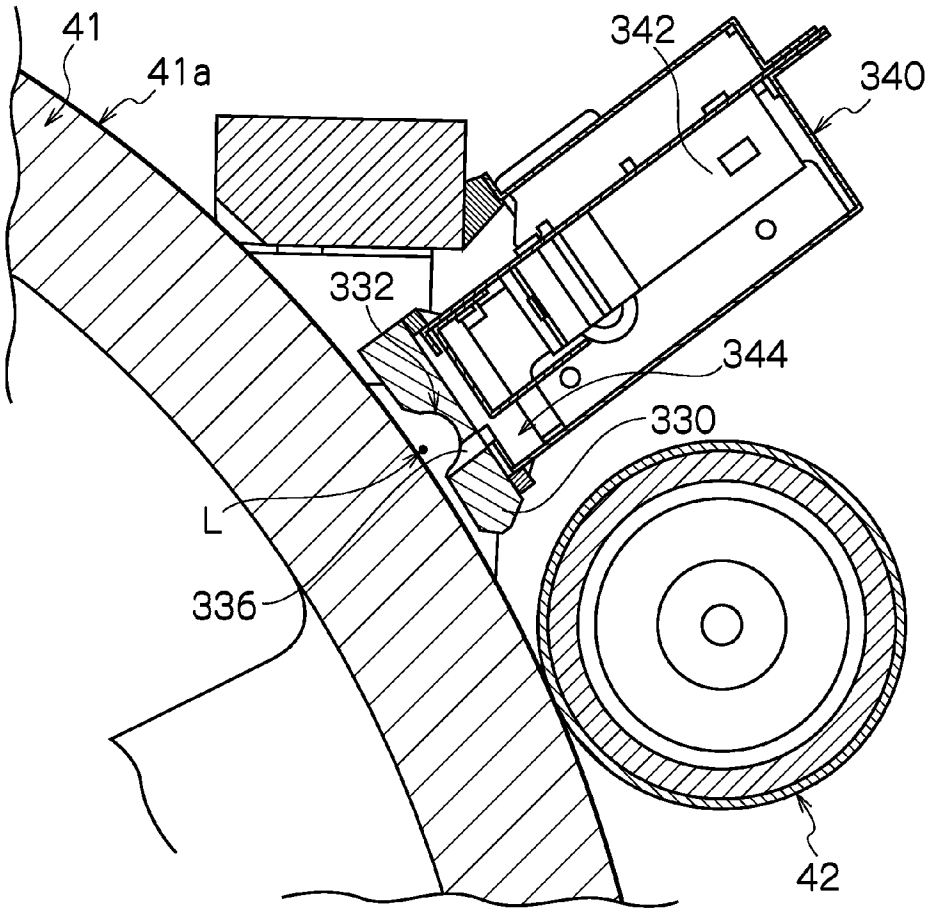
FIG. 8 is a cross-sectional diagram of an air flow diverting guide member and a fan unit in a direction perpendicular to the axial direction of the drum.

FIG. 8 shows a cross-sectional diagram of the air flow diverting guide member 330 and the fan unit 340, and so on, in the direction perpendicular to the axial direction of the drum. The inkjet heads 44C, 44M, 44Y and 44K are not depicted in FIG. 8. As shown in FIG. 8, an air blowing fan 342 and an air blowing channel 344 are arranged inside the fan unit 340. The air flow diverting guide member 330 has an air blowing aperture 336, which connects the air blowing channel 344 of the fan unit 340 and the space inside the semicircular cylindrical groove 332 (the space between the air flow diverting guide member 330 and the conveyance surface 41*a*).

In practice, a plurality of air blowing holes 336 are formed as elongated hole-shaped slits, as denoted with the same reference numeral 336 in FIG. 4, for example.

By means of the air blowing fan 342, air which has no temperature differential in the vicinity of the conveyance surface 41*a* of the image recording drum 41 is blown from the air blowing channel 344 in the fan unit 340 into the semicircular cylindrical groove 332, through the air blowing aperture 336 in the air flow diverting guide member 330. Thus, the air in the periphery of the optical path of the detection light L which passes inside the semicircular cylindrical groove 332 is kept to a substantially uniform temperature.

Figure 9:
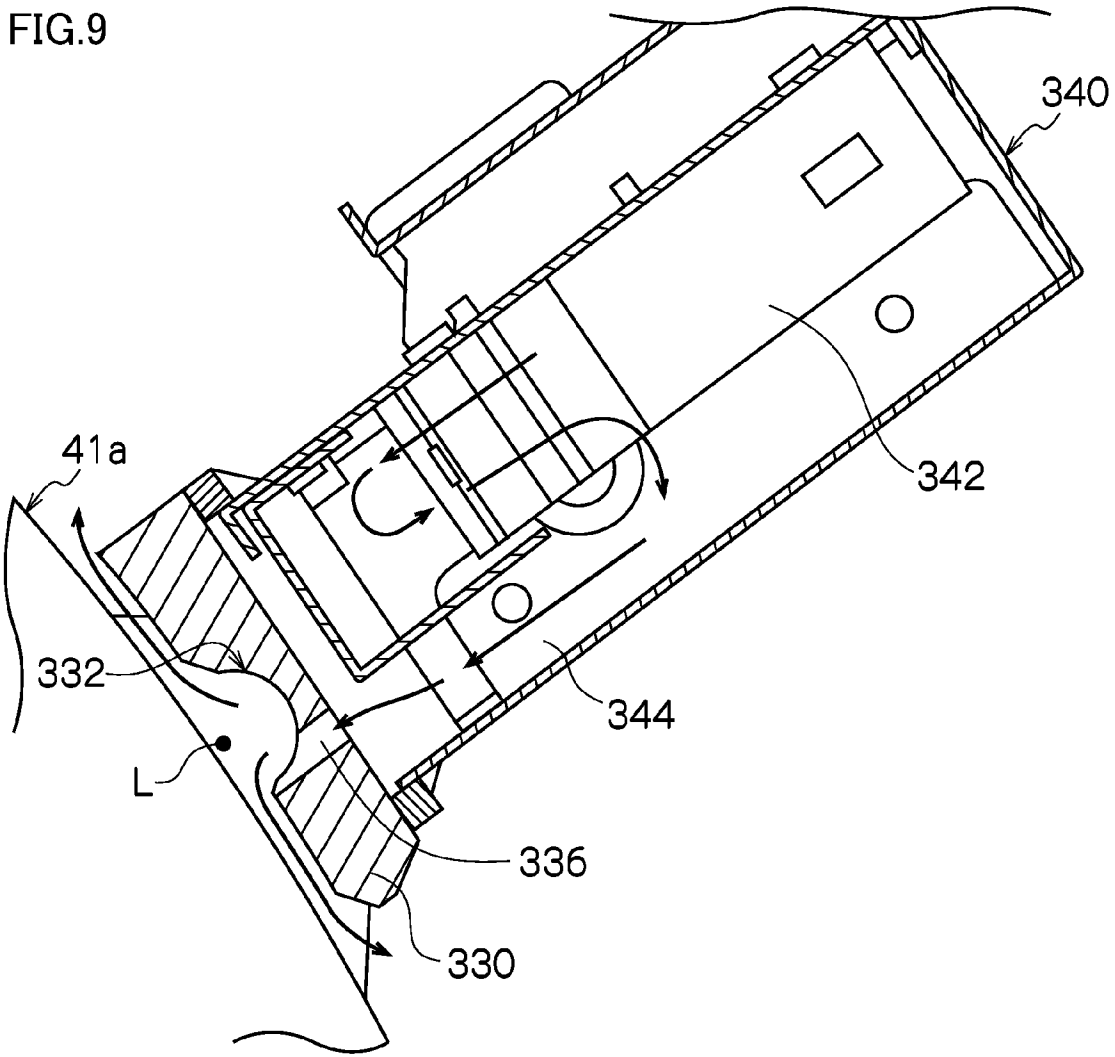
FIG. 9 is an illustrative diagram showing the flow of air produced by an air blowing fan.

FIG. 9 shows the flow of air produced by the air blowing fan 342. As indicated with arrows in FIG. 9, the air blown by the air blowing fan 342 moves directly downward inside the fan unit 340 from the air blowing fan 342, strikes the bottom face of the fan unit 340, and is then redirected upward, so as to flow through the air blowing channel 344, and then flows through the air blowing channel 336 in the air flow diverting guide member 330 into the semicircular cylindrical groove 332.

The air which has flowed into the semicircular cylindrical groove 332 then exits to the upstream side and the downstream side in terms of the conveyance direction of the paper P, through gaps between the guide surface 334 of the air flow diverting guide member 330 and the conveyance surface 41*a*. Thereby, the air having a temperature differential with respect to the air inside the semicircular cylindrical groove 332 is prevented from entering by the air flow which exits to the upstream side and the downstream side in terms of the conveyance direction of the paper P, from the gaps between the guide surface 334 of the air flow diverting guide member 330 and the conveyance surface 41*a*. Thus, it is possible to maintain a substantially uniform temperature inside the semicircular cylindrical groove 332 through which the detection light L passes.

Depending on the type of paper P and the state of floating, and so on, when the paper P is floating from the conveyance surface 41*a*, the floating paper P may be depressed to a concave state due to the pressure of the air flow which is blown into the semicircular cylindrical groove 332. In this case, if detection of floating is carried out with the paper P floating in a concave state during conveyance, then the floating which ought to be detected will not be detected, the paper P will be too close to the inkjet heads 44C, 44M, 44Y and 44K, giving rise to poor image quality, and depending on the circumstances, the paper becomes in contact with the heads. Therefore, it is desirable that the pressure of the air flow blown into the semicircular cylindrical groove 332 is lower than a pressure which makes the upward floating of paper P during conveyance assume a concave shape.

Furthermore, in the embodiment described above, the air blowing aperture 336 for blowing air into the semicircular cylindrical groove 332 from the fan unit 340 is arranged in the position where air is blown directly inside the semicircular cylindrical groove 332; however, the position of the air blowing aperture 336 is not limited to this location.

For example, if the flow of external air having a large temperature differential into the semicircular cylindrical groove 332 is from only one of the upstream side and the downstream side in terms of the conveyance direction of the paper P, or if there is a possibility that the pressure of the air flowing in will make the floating of the paper P assume a concave shape, then it is possible to provide an air blowing aperture 336 either on only one side, or both sides, of the upstream side and the downstream side of the guide surface 334 of the air flow diverting guide member 330.

Figure 10A:
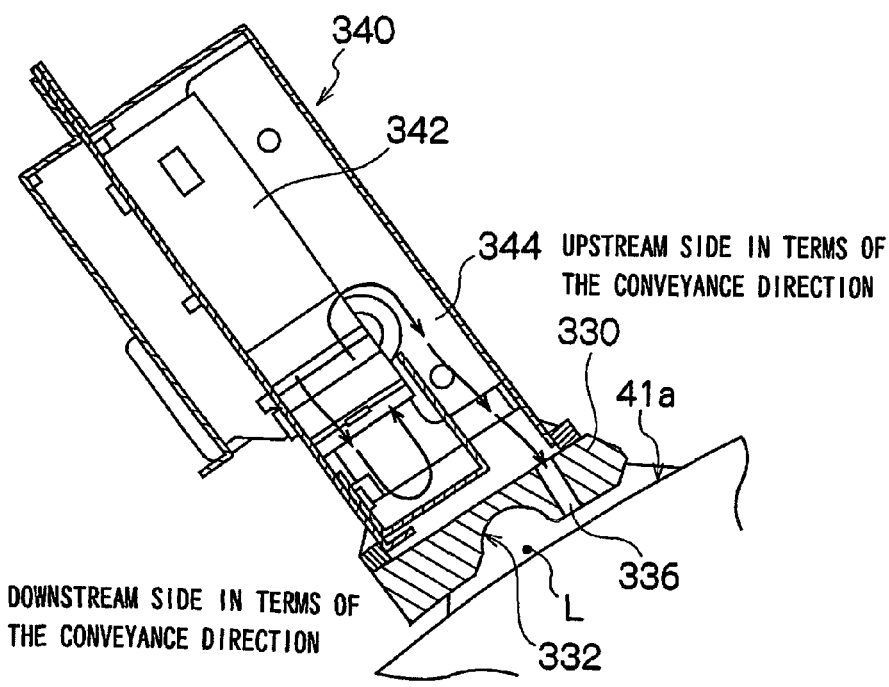
FIGS. 10A and 10B are illustrative diagrams respectively showing further arrangements of an air blowing aperture in the air flow diverting guide member.

For instance, if external air having a temperature differential flows into the air flow diverting guide member 330 from only the upstream side in terms of the conveyance direction of the paper P, then as shown in FIG. 10A, the air blowing aperture 336 arranged in the air flow diverting guide member 330 is disposed to the upstream side of the semicircular cylindrical groove 332, and air is blown onto the conveyance surface 41*a* from the upstream side. By this means, it is possible to prevent air having a large temperature differential from flowing from the upstream side into the gap between the guide surface 334 of the air flow diverting guide member 330 and the conveyance surface 41*a*.

Moreover, in this case, the position at which the air flow blown out from the air blowing aperture 336 strikes the paper P is to the upstream side of the position of the optical path of the detection light L. Consequently, even if the floating of the paper P becomes concave at this position, the floating of the paper P returns again to the original shape by the time that the paper P is conveyed to the position of detection light L, and hence there is no problem.

Figure 10B:
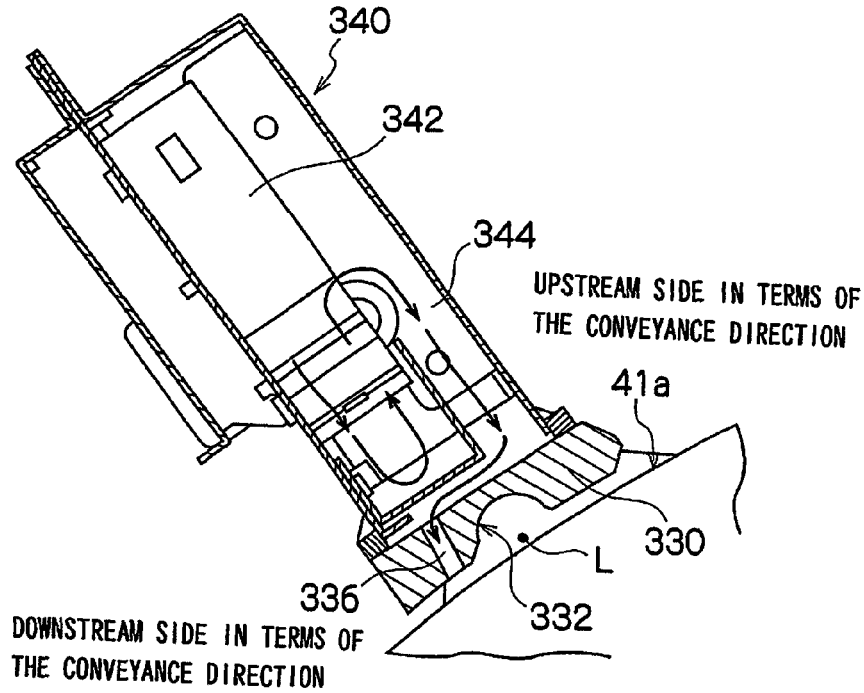

Furthermore, if external air having a temperature differential flows into the air flow diverting guide member 330 from only the downstream side in terms of the conveyance direction of the paper P, as shown in FIG. 10B, then the air blowing aperture 336 arranged in the air flow diverting guide member 330 is disposed to the downstream side of the semicircular cylindrical groove 332, and air is blown onto the conveyance surface 41*a* from the downstream side. Thus, it is possible to prevent air having a large temperature differential from flowing from the downstream side into the gap between the guide surface 334 of the air flow diverting guide member 330 and the conveyance surface 41*a*.

Moreover, if air having a large temperature differential flows into the air flow diverting guide member 330 from both the upstream side and the downstream side in terms of the conveyance direction of the paper P, and the floating of the paper P may assume a concave shape, then it is possible to dispose air blowing apertures 336 on both the upstream side and the downstream side of the semicircular cylindrical groove 332.

In the present embodiment, the air flow which has been blown onto the conveyance surface 41*a* may be circulated in order to suppress the temperature differential between the air flow blown in order to maintain the temperature environment in the periphery of the optical path of the detection light L and the image recording drum 41 and the like.

Figure 11:
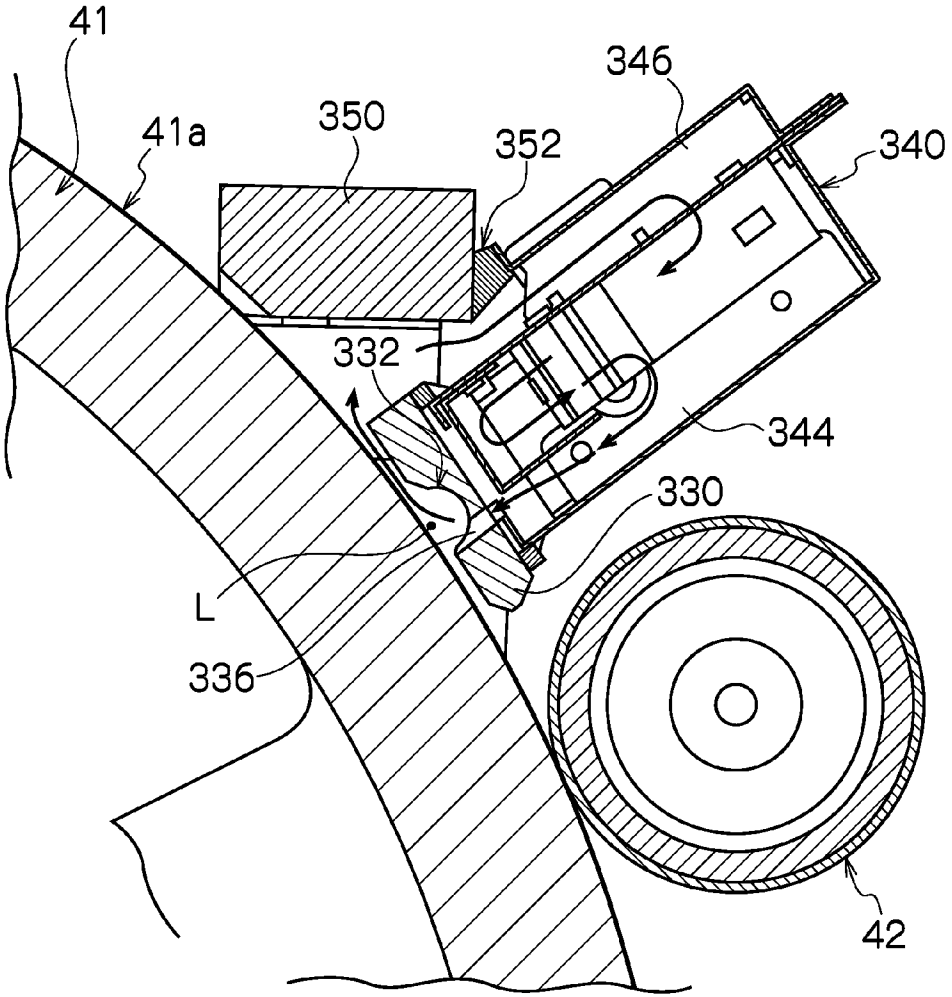
FIG. 11 is an illustrative diagram showing a mode of circulating an air flow blown from the fan unit.

More specifically, as shown in FIG. 11, for example, a bar 350 is arranged in parallel with the air flow diverting guide member 330 and the fan unit 340 along the conveyance surface 41*a*. The bar 350 is a bar-shaped member traversing the conveyance surface 41*a*, and is depicted in cross-section in FIG. 11. The light emission unit 310 and the light reception unit 320 (not shown in FIG. 11; see FIG. 7, for example) are attached to the ends of the bar 350. Thus, a portion of the space to the upstream side of the air flow diverting guide member 330 is shielded in such a manner that the air is circulated as indicated with arrows in FIG. 11.

More specifically, as shown in FIG. 11, the air blown by the air blowing fan 342 firstly flows upward from the bottom surface inside the fan unit 340 and then enters into the semicircular cylindrical groove 332 from the air blowing channel 344 through the air blowing aperture 336. The air flow exiting to the downstream side from the gap between the air flow diverting guide member 330 and the conveyance surface 41*a* is blocked by the bar 350 and is caused by the air blowing fan 342 to enter again, as before, from an air intake port 346 of the fan unit 340 which is arranged on the upper side.

It is desirable to arrange a seal member 352 between the bar 350 and the air intake port 346 of the fan unit 340 in order to prevent leakage of the circulating air at this point.

According to the present embodiment, since the optical path of the detection light L is covered with the air flow diverting guide member 330 and the fan unit 340 is arranged in such a manner that external air having a temperature differential sufficient to affect the optical path direction does not enter into the peripheral space of the optical path, then it is possible to maintain a substantially uniform temperature environment about the periphery of the optical path and floating of the paper can be detected with good accuracy.

In the embodiments described above, a member in which a semicircular cylindrical groove is formed is used as the air flow diverting guide member, but the present invention is not limited to this shape, and it is possible to use a member having a suitable shape, appropriately, in accordance with the direction of the air flowing toward the optical path, such as a flat plate-shaped member which covers the upper portion of the optical path of the detection light, or members which cover the upper portion of the optical path and the front and rear sides in the conveyance direction.

Moreover, in each of the embodiments described above, the paper conveyance device is the drum (image recording drum), but the present invention can also be applied to the case of belt conveyance, in addition to drum conveyance.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A paper floating detection apparatus arranged at a conveyance path of a conveyance device which holds paper on a conveyance surface and conveys the paper through the conveyance path in a conveyance direction while causing a surface of the paper to face a droplet ejection head, the apparatus comprising:

a light emission unit and a light reception unit which are arranged to face each other across the conveyance path, the light emission unit and the light reception unit being disposed in such a manner that an optical path of detection light emitted from the light emission unit and received by the light reception unit is substantially perpendicular to the conveyance direction, floating up of the paper from the conveyance surface being detected by detecting that the conveyed paper has shielded the detection light;

an air flow diverting guide member which is arranged in a periphery of the optical path and configured to prevent inflow of air having a temperature differential sufficient to affect the optical path; and an air blowing device which blows air having substantially no temperature differential with respect to air in the periphery of the optical path, toward a space between the air flow diverting guide member and the conveyance surface.

2. The paper floating detection apparatus as defined in claim 1, wherein the air flow diverting guide member includes a flat plate-shaped member which covers the optical path at an upper side of the optical path with respect to the conveyance surface.

3. The paper floating detection apparatus as defined in claim 1, wherein the air flow diverting guide member includes a covering member which covers the optical path at an upper side of the optical path with respect to the conveyance surface, and an upstream side and a downstream side of the optical path in terms of the conveyance direction.

4. The paper floating detection apparatus as defined in claim 3, wherein the covering member has a guide surface which faces the conveyance surface and has a semicircular cylindrical groove through which the detection light passes formed therein through a whole width of the conveyance path.

5. The paper floating detection apparatus as defined in claim 3, wherein:

the conveyance device includes a drum conveyance device which conveys the paper while holding the paper by attraction on a circumferential surface of a drum serving as the conveyance surface while gripping a leading end of the paper by a gripping device arranged on the circumferential surface of the drum;

the light emission unit and the light reception unit are arranged on sides of the circumferential surface of the drum in such a manner that the optical path of the detection light is substantially parallel to an axial direction of the drum; and the covering member has a guide surface which faces the circumferential surface of the drum and has a semicircular cylindrical groove through which the detection light passes formed therein, and the covering member is arranged substantially in parallel with the axial direction of the drum.

6. The paper floating detection apparatus as defined in claim 5, wherein the guide surface has a curvature to match a curvature of the circumferential surface of the drum.

7. The paper floating detection apparatus as defined in claim 1, wherein:

the air flow diverting guide member has an air blowing aperture which connects an air blowing path of the air blowing device with the space between the air flow diverting guide member and the conveyance surface; and the air blowing device blows the air toward the conveyance surface through the air blowing aperture.

8. The paper floating detection apparatus as defined in claim 7, wherein the air blowing aperture is arranged so that the air is blown onto the conveyance surface in a vicinity of the optical path.

9. The paper floating detection apparatus as defined in claim 7, wherein the air blowing aperture is arranged so that the air is blown onto the conveyance surface on the upstream side of the optical path in terms of the conveyance direction.

10. The paper floating detection apparatus as defined in claim 7, wherein the air blowing aperture is arranged so that the air is blown onto the conveyance surface on the downstream side of the optical path in terms of the conveyance direction.

11. The paper floating detection apparatus as defined in claim 1, wherein the air flow diverting guide member and the air blowing device have a path through which the air blown from the air blowing device is circulated in order to suppress temperature difference between the conveyance device and the air blown from the air blowing device.

12. A paper conveyance apparatus comprising the paper floating detection apparatus as defined in claim 1.

13. An image recording apparatus comprising the paper conveyance apparatus as defined in claim 12.

14. The paper floating detection apparatus as defined in claim 1, wherein pressure of the air blown into the air flow diverting member is lower than a pressure which makes upward floating of the paper during conveyance assume a concave shape.

* * * * *